United States Patent [19]

Mao

[11] Patent Number: 4,574,861

[45] Date of Patent: Mar. 11, 1986

[54] THERMAL SHADE

[75] Inventor: Chung-Rei Mao, Omaha, Nebr.

[73] Assignee: InterNorth, Inc., Omaha, Nebr.

[21] Appl. No.: 540,434

[22] Filed: Oct. 11, 1983

[51] Int. Cl.[4] ..... E06B 9/08

[52] U.S. Cl. ..... 160/133; 160/232

[58] Field of Search ..... 160/133, 229 B, 231 A, 160/231 R, 235, 201, 232, 209, 236, 84 R; 428/54, 55, 56

[56] References Cited

U.S. PATENT DOCUMENTS

| | | | |
|---|---|---|---|
| 2,054,499 | 9/1936 | Florman | 160/231 R |
| 2,877,843 | 3/1959 | Stroup | 160/209 |
| 3,019,486 | 2/1962 | Stinson | 160/231 A |
| 3,635,278 | 1/1972 | Bocade | 160/206 |
| 4,027,715 | 6/1977 | Tohma | 160/354 |
| 4,037,639 | 7/1977 | Jones | 160/133 |
| 4,341,253 | 7/1982 | Eyerle | 160/133 |
| 4,436,136 | 3/1984 | Downey, Jr. | 160/236 |
| 4,445,958 | 5/1984 | Jaksha | 160/133 X |

FOREIGN PATENT DOCUMENTS

| | | | |
|---|---|---|---|
| 2098537 | 3/1972 | France | 160/232 |

*Primary Examiner*—Ramon S. Britts
*Assistant Examiner*—Cherney S. Lieberman
*Attorney, Agent, or Firm*—Donald F. Haas

[57] ABSTRACT

A thermal shade for limiting the amount of thermal energy which enters a structure through an opening therein is disclosed. The shade comprises a plurality of integrally formed elongated closed rectangular tubes which have a dead air space, are arranged in parallel relation to each other, and are connected on the side opposite the opening by living hinges. The shade also includes means for positioning shade to limit the thermal energy entering the opening.

2 Claims, 3 Drawing Figures

THERMAL SHADE

BACKGROUND OF THE INVENTION

The present invention relates to an apparatus for providing insulation against radiant, conductive, and convective heat transmission. This invention also relates to an apparatus for providing such insulation in areas such as windows and doors in residential, commercial, and industrial buildings that ordinarily are relatively good heat transmitters. Finally, the present invention relates to an apparatus for providing thermal insulation in areas which require that the insulation material be easily removed so that it does not permanently block windows or doors.

A conventional storm window is expensive and inefficient for preventing the transfer of thermal energy therethrough. In the winter, a significant amount of heat can escape from a structure through such windows. Similarly, in the summer, the total heat entering such a window is much greater than the heat which enters through the surrounding walls. Thus, it can bee seen that there is a need for a thermally insulating shade for windows and doors which can be easily removed when not needed.

U.S. Pat. No. 4,037,639, issued July 26, 1977, discloses a thermal barrier which is comprised of a plurality of elongated hollow lens-shaped slats connected by pivot means and forming a shade which can be slidably mounted in a window or door frame. The means of connecting the adjacent slats inherently allows air leaks which lower the efficiency of the shade. Also, the exposure of the pivot structure to ultraviolet light will shorten their useful lifetime. Also, the lens shape of the slats provides less dead air space for insulation.

SUMMARY OF THE INVENTION

The present invention is a thermal shade for limiting the amount of thermal energy which enters a structure through an opening therein. The shade is comprised of a plurality of integrally formed elongated closed rectangular tubes which have a dead air space, are arranged to parallel relation to each other, and are connected on the side opposite the opening by a living hinge. The shade also includes means for positioning the shade so as to limit the thermal energy entering the opening. The width of the living hinges is preferably small in relation to the width of the tubes so that the hinges have very little exposure to light passing through the opening.

The positioning means can be a guide means adapted to be slidably mounted in tracks adjacent the opening. Each of the tubes may have an extended cover on the side opposite the opening which extends beyond the tracks in close relation thereto to prevent air leaks therefrom. The guide means may include means for adapting the shade for mounting at openings of different sizes.

DETAILED DESCRIPTION OF THE INVENTION

Figure 2:
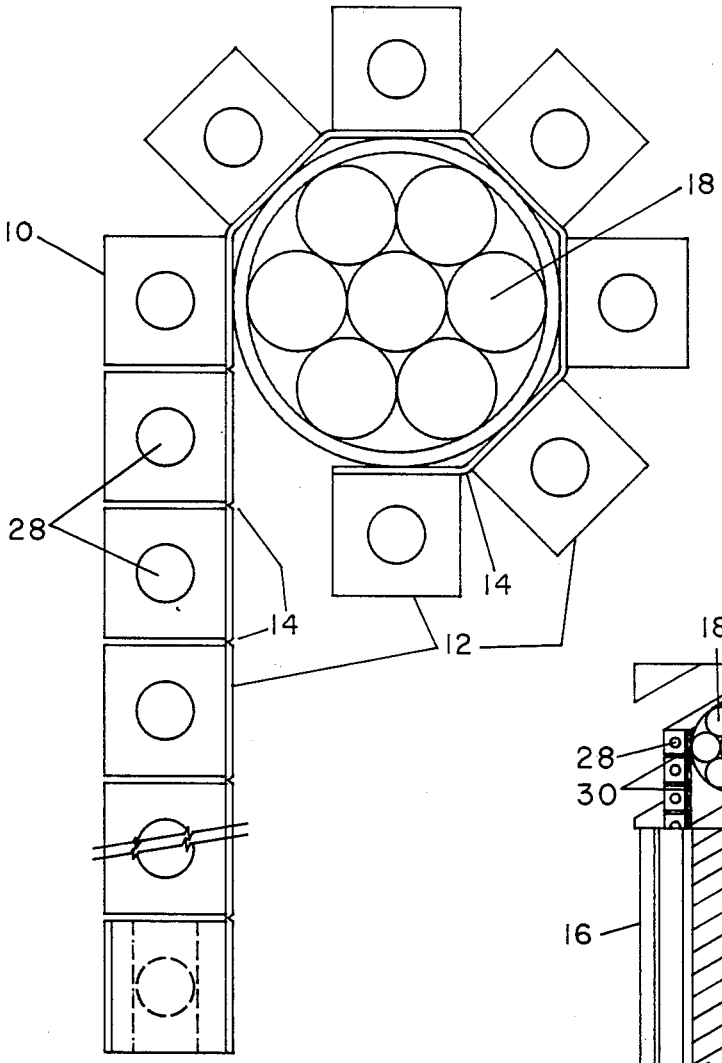
FIG. 2 is a side view of the shade as it is stored when not in use.
Figure 3:
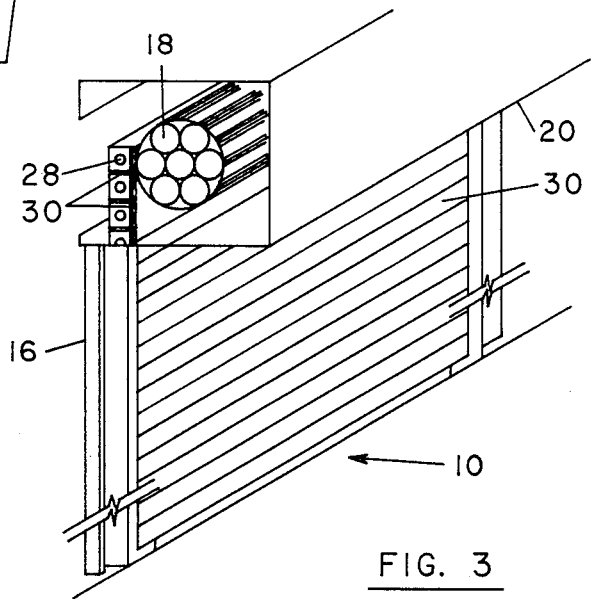
FIG. 3 is a perspective view showing the shade mounted at a window frame and illustrating the storage box.

FIGS. 2 and 3 show the thermal shade 10 which is comprised of a plurality of integrally formed elongated closed rectangular tubes 12 which are connected by living hinges 14. A living hinge is a flexible connection between two relatively inflexible objects integral therewith wherein the connection itself does the bending. Thus, a living hinge requires a flexible necked-down portion integrally connected to relatively inflexible members at opposite sides of the necked-down portion, thus eliminating frictional rotational engagement of one of the members with the other. By neck-down it is meant that the width of the living hinges is small in relation to the width of the tubes 12. This is advantageous because it limits the exposure of the living hinges 14 to outside light thereby decreasing their failure rate due to exposure to ultraviolet light.

Figure 1:
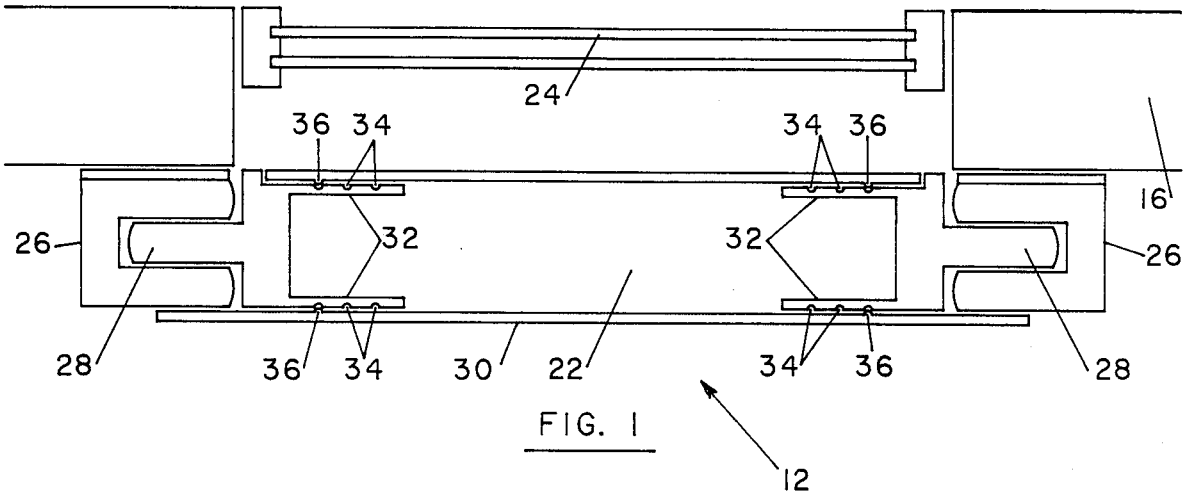
FIG. 1 is a top view of the shade mounted at a window opening in a structure.

As shown in FIGS. 1 and 3, the shade 10 can be mounted at a window frame 16 so that it can be extended downwardly to insulate the window, as shown in FIG. 3, or rolled up on a roller means 18 and stored in a storage box 20 when not in use. The living hinges 14 are flexible enough to allow the shade 10 to be rolled up as shown in FIG. 2.

FIG. 1 illustrates how one of the tubes 12 is slidably mouned at the outside of window frame 16. It can also be mounted on the inside of frame 16. The tube 12 has a large dead air space within it which operates as an effective insulator against conductive and convective heat transmission through the window 24.

Tracks 26 are mounted adjacent to the window frame 16. Guide members 28 are positioned at both ends of the tubes 12 and are adapted to be slidably mounted in the tracks 26. Each of the tubes 12 has a cover 30 on the side thereof opposite the window 24 which extends outwardly beyond the tracks 26 in close relation thereto to prevent air leaks therefrom.

The guide members 28 each have two notched members 32 extending inwardly into the tube 12. The notches 34 are adapted for communication with the bumps 36 which are formed in the sidewalls of the tube 12. The guide members 28 can be moved inwardly or outwardly to vary the size of the tube 12 so that it will fit in window frames of different sizes. The communication of the notches 34 and the bumps 36 secures the guide members 28 and prevents their movement once the shade 10 is installed at the window frame 16.

The rectangular shape of the tubes of the thermal shade provides a large amount of insulating dead air space because the rectangular shape of the tubes provides a greater insulation capacity than other shapes which would then require a larger size to provide the same amount of insulation. It also reduces the amount of surface area of the hinges thereby reducing the amount of insulation efficiency which occurs at the hinges. Furthermore, the narrow space between the tubes when the shade is in use decreases the exposure of the hinges to ultraviolet light and thus increases their useful life.

The living hinges are an important part of the present invention. They allow the shade to be flexible enough so that it can be wound up and stored while not in use. More importantly, they also reduce the amount of air leaks which can occur through the shade because they are integrally formed with the tubes and thus there is no opportunity for the air to leak from one side of the shade to the other between the tubes. Finally, a more compact storage box can be used than in prior art devices because the living hinges are very flexible.

The extended cover which is positioned on the inside of each of the tubes also increases the insulation efficiency of the thermal shade of the present invention. The cover extends from the tubes beyond the edges of the tracks and is positioned in very close relationship to the tracks so that very little air can leak from the window side of the tracks to the inside of the structure.

I claim:

1. A thermal shade for limiting the amount of thermal energy which enters a structure through an opening therein, said shade comprising:

(a) a plurality of integrally formed elongated closed rectangular tubes which have a dead air space, are arranged in parallel relation to each other, and are connected by living hinges, and (b) means for positioning said shade to limit the thermal energy entering said opening, wherein said positioning means is a guide means adapted to be slidably mounted in tracks adjacent said opening, and wherein each of said tubes has an extended cover on the side opposite said opening and which extends beyond said tracks in close relation thereto to prevent air leaks therefrom.

2. A thermal shade for limiting the amount of thermal energy which enters a structure through an opening therein and adapted for mounting in tracks adjacent said opening, said shade comprising:

(a) A plurality of integrally formed elongated closed rectangular tubes which have a dead air space, are arranged in parallel relation to each other, and are connected on the side opposite the opening by living hinges, the width of which is small in relation to the width of the tubes such that the hinges have very little exposure to light passing through the opening, (b) Guide means for slidably mounting said shade in said tracks to limit the thermal energy entering said opening wherein said guide means includes means for adapting said shade for mounting at openings of different sizes, and (c) An extended cover on each of said tubes on the side opposite said opening which extends beyond said tracks in close relation thereto to prevent air leaks therefrom.

* * * * *

UNITED STATES PATENT AND TRADEMARK OFFICE

CERTIFICATE OF CORRECTION

PATENT NO. : 4,574,861

DATED : March 11, 1986

INVENTOR(S) : Chung-Rei Mao

It is certified that error appears in the above—identified patent and that said Letters Patent is hereby corrected as shown below:

Column 2, line 57, delete "efficiency" and insert therefor--inefficiency--.

Column 1, line 23, delete "bee" and insert therefor--be--.

Column 1, line 44, delete "to" and insert therefor--in--.

Signed and Sealed this

Twenty-fifth Day of November, 1986

*Attest:*

DONALD J. QUIGG

*Attesting Officer* *Commissioner of Patents and Trademarks*